US009573101B2

(12) United States Patent
Lee

(10) Patent No.: US 9,573,101 B2
(45) Date of Patent: Feb. 21, 2017

(54) MICRO-BUBBLE GENERATOR FOR SHOWERHEAD

(71) Applicant: Ransom Man Pan Lee, Kowloon (HK)

(72) Inventor: Ransom Man Pan Lee, Kowloon (HK)

(73) Assignee: AQUAmate K&B Limited, Kowloon (HK)

( * ) Notice: Subject to any disclaimer, the term of this patent is extended or adjusted under 35 U.S.C. 154(b) by 159 days.

(21) Appl. No.: 14/700,171

(22) Filed: Apr. 30, 2015

(65) Prior Publication Data

US 2016/0317987 A1 Nov. 3, 2016

(51) Int. Cl.

| | |
|---|---|
| ***B01F 3/04*** | (2006.01) |
| ***B01F 5/06*** | (2006.01) |
| ***E03C 1/02*** | (2006.01) |
| ***B05B 1/18*** | (2006.01) |

(52) U.S. Cl.

CPC ..... *B01F 5/0644* (2013.01); *B01F 3/04503* (2013.01); *B05B 1/185* (2013.01); *E03C 1/025* (2013.01)

(58) Field of Classification Search

CPC .... B01F 3/04503; B01F 5/0644; B05B 1/185; E03C 1/025

USPC ..... 261/76, DIG. 75

See application file for complete search history.

(56) References Cited

U.S. PATENT DOCUMENTS

| | | | | |
|---|---|---|---|---|
| 7,758,024 | B2 * | 7/2010 | Takahashi | A45D 19/14 261/28 |
| 7,913,984 | B2 * | 3/2011 | Noguchi | B01F 3/0446 261/29 |
| 2005/0077636 | A1 * | 4/2005 | Bortkevitch | B01F 3/0446 261/76 |
| 2006/0027100 | A1 * | 2/2006 | Kozyuk | B01F 3/0446 95/260 |
| 2007/0257381 | A1 * | 11/2007 | Chuang | B01F 3/0446 261/76 |
| 2013/0168879 | A1 * | 7/2013 | Lee | B01F 5/043 261/76 |
| 2014/0264966 | A1 * | 9/2014 | Gillette | A23L 3/358 261/76 |

* cited by examiner

*Primary Examiner* — Charles Bushey

(57) ABSTRACT

The present invention is a micro-bubble generator including a housing, a bubble generator means and a seal means. The bubble generator is securedly received within the housing and has a top, a body positioned downstream from the top and having a diameter smaller than diameter of the inner wall of the housing so that a circumferential gap is formed between an outer lateral surface of the body and the inner wall of the housing, and a recess coaxially extending from the top to a portion of the body, wherein a plurality of water passages extend radially outward from the recess to the outer lateral surface of the body so that each of the water passages is in communication with the circumferential gap. The seal provides selective communication from the plurality of apertures to the top of the bubble generator.

10 Claims, 4 Drawing Sheets

MICRO-BUBBLE GENERATOR FOR SHOWERHEAD

BACKGROUND OF THE INVENTION

The present invention relates to a micro-bubble generator and more particularly pertains to a micro-bubble generator for showerhead.

Showerheads with bubble generator are available in the marketplace, but their structures are often complicated. Besides, the bubbles generated are not sufficiently small in size and thus fail to offer an excellent user experience.

BRIEF SUMMARY OF THE INVENTION

In view of the aforesaid disadvantages now present in the prior art, the present invention provides a micro-bubble generator for showerhead which is simple in structure and capable of producing micro-bubbles which are about 1.5 microns in diameter.

To attain this, the present invention generally comprises:

a housing having a water inlet at a first end thereof, a water outlet at a second end thereof, and a plurality of apertures provided circumferentially around a lateral surface of the housing;

a bubble generating means securedly received within the housing and having a top which is engaged with an inner wall of the housing in a watertight manner, a body positioned downstream from the top and having a diameter smaller than diameter of the inner wall of the housing so that a circumferential gap is formed between an outer lateral surface of the body and the inner wall of the housing, and a recess coaxially extending from the top to a portion of the body, wherein a plurality of water passages extend radially outward from the recess to the outer lateral surface of the body so that each of the water passages is in communication with the circumferential gap; and a sealing means disposed between the housing and the bubble generating means which provides selective communication from the plurality of apertures to the top of the bubble generating means.

The circumferential gap is approximately 0.5 mm in width.

Each of the water passages is approximately 1.5 mm to 2.0 mm in diameter.

The body of the bubble generating means is tapered inwards at a downstream end thereof to help reduce pressure of water flowing from the circumferential gap and to allow micro-bubbles in water flowing from the circumferential gap to disperse evenly.

A mounting bracket is provided upstream of the bubble generating means, and the mounting bracket is fixedly positioned in relation to the housing so as to leave a gap between the housing and the mounting bracket, and the gap provides communication between the plurality of apertures and the top of the bubble generating means; the sealing means is in form of an annular ring having an outer downward extending flange portion and an inner upward extending flange portion; the outer downward extending flange portion is securedly disposed at the gap between the housing and the mounting bracket in a way to seal an end of the gap; the inner upward extending flange portion is disposed towards an other end of the gap and movable between a sealing position where it blocks communication from the plurality of apertures to the top of the bubble generating means and a non-sealing position where it allows communication from the plurality of apertures to the top of the bubble generating means.

A connector having a first portion, a second portion and a bore therethrough; the first portion is threadedly engaged with a downstream end of the housing, and the second portion has a threaded external wall for threadedly engaging with a downstream water pipe. The connector is also provided with upward extending protrusions abutting against a downstream end of the body of the bubble generating means for supporting the bubble generating means in position.

The upstream end of the housing is internally threaded for engaging with an upstream water pipe.

The housing is made of plastics or copper.

The bubble generating means is made of copper or plastics.

DETAILED DESCRIPTION OF THE INVENTION

Figure 1:
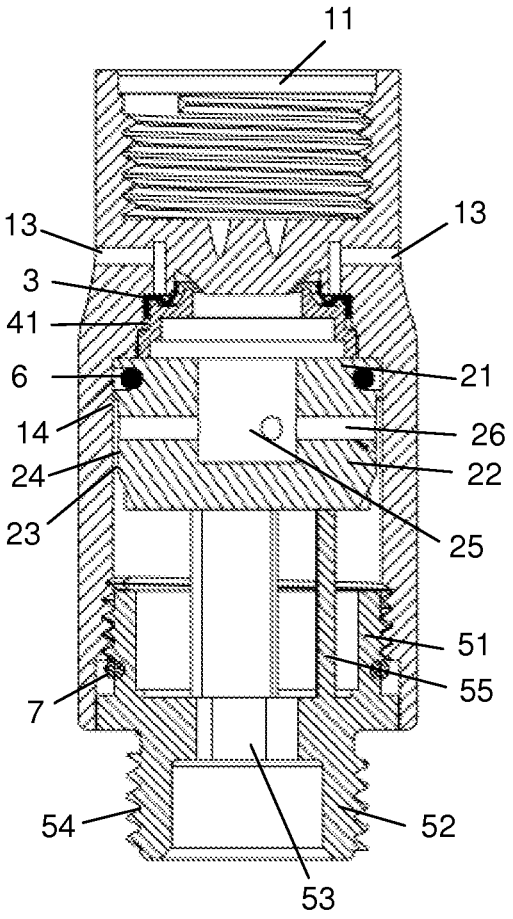
FIG. 1 is a cross sectional view of a preferred embodiment of the present invention.
Figure 2:
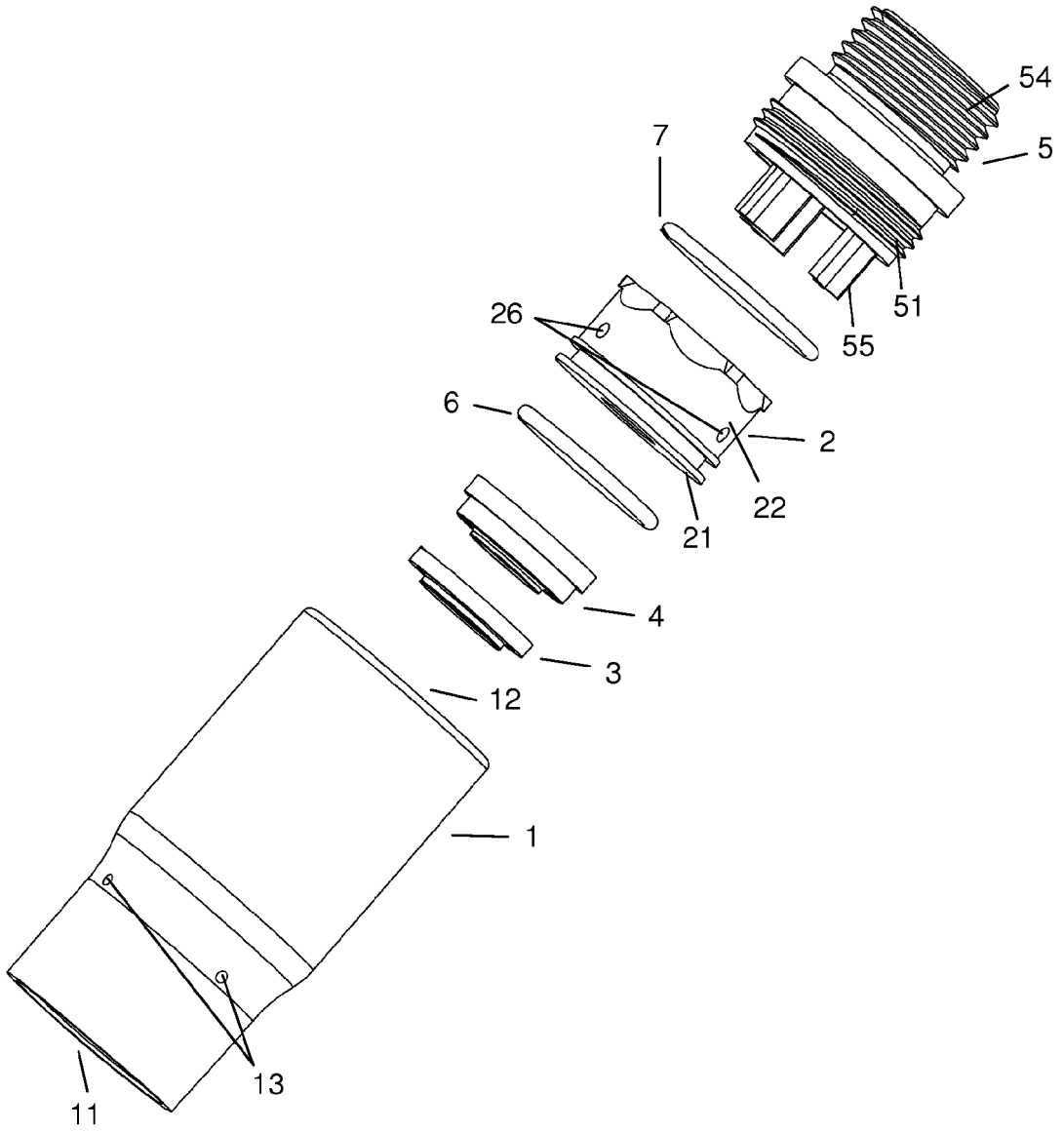
FIG. 2 is a disassembling view of the embodiment of the present invention as shown in FIG. 1.
Figure 3:
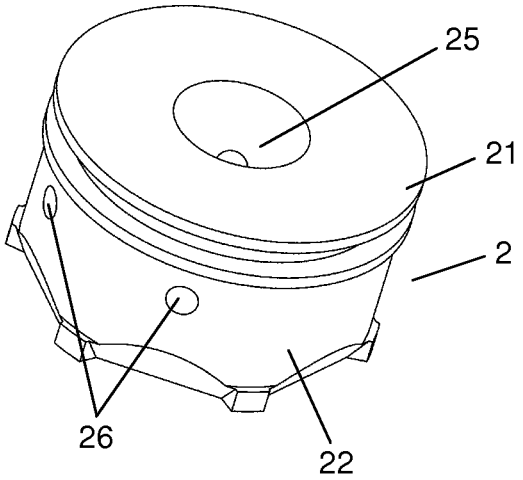
FIG. 3 is a perspective view of the bubble generating means of the embodiment of the present invention as shown in FIG. 1.
Figure 4:
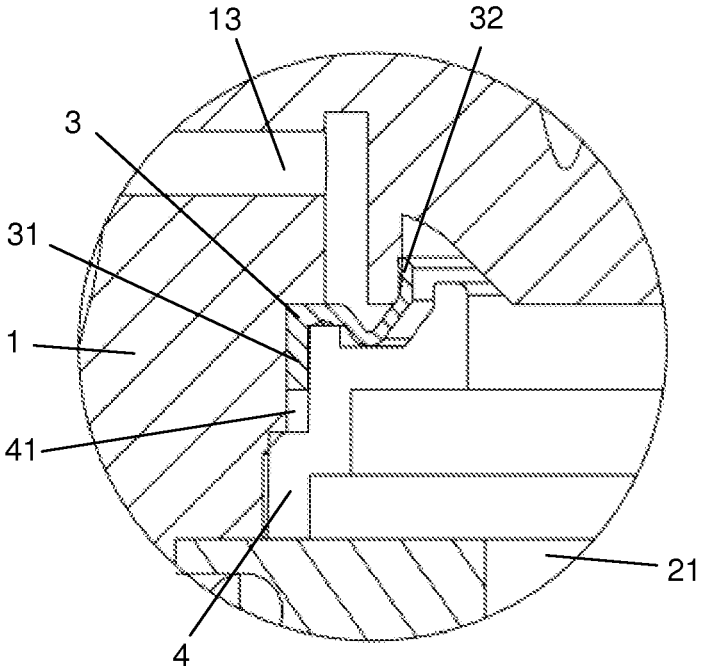
FIG. 4 is an enlarged cross sectional view showing the sealing means in the sealing position of the embodiment of the present invention as shown in FIG. 1.
Figure 5:
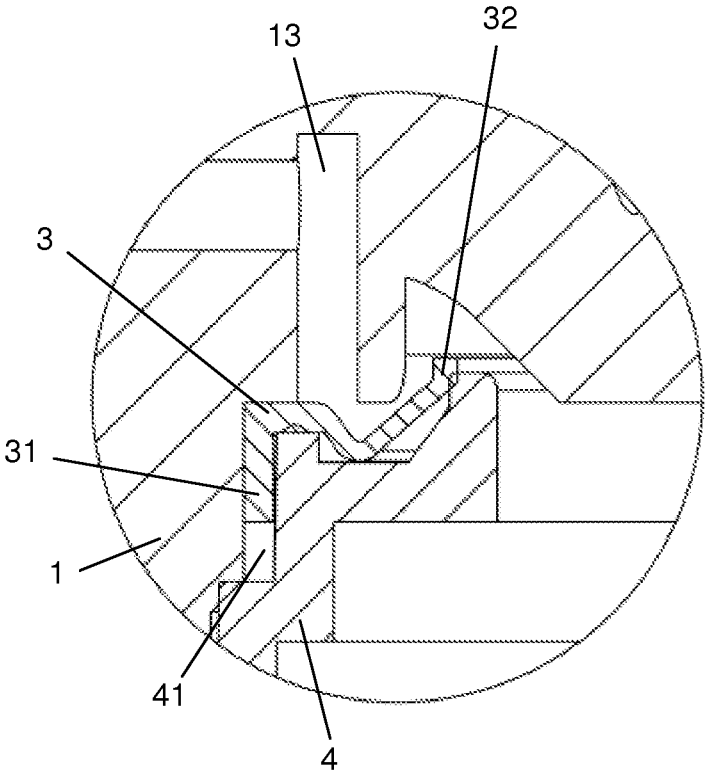
FIG. 5 is an enlarged cross sectional view showing the sealing means in the non-sealing position of the embodiment of the present invention as shown in FIG. 1.

As illustrated, the present embodiment comprises a housing 1, a bubble generating means 2 and a sealing means 3. The housing 1 has a water inlet 11 at a first end thereof, a water outlet 12 at a second end thereof, and a plurality of apertures 13 provided circumferentially around a lateral surface of the housing 1. The bubble generating means 2 is securedly received within the housing 1 and has a top 21 which is engaged with an inner wall 14 of the housing 1 in a watertight manner by means of an O-ring 6, a body 22 positioned downstream from the top 21 and having a diameter smaller than diameter of the inner wall 14 of the housing so that a circumferential gap 23 is formed between an outer lateral surface 24 of the body 22 and the inner wall 14 of the housing 1, and a recess 25 coaxially extending from the top 21 to a portion of the body 22, wherein a plurality of water passages 26 extend radially outward from the recess 25 to the outer lateral surface 24 of the body 22 so that each of the water passages 26 is in communication with the circumferential gap 23. In this embodiment, the circumferential gap 23 is approximately 0.5 mm in width. Each of the water passages 26 is approximately 1.5 mm to 2.0 mm in diameter. The body 22 of the bubble generating means 2 is tapered inwards at a downstream end thereof.

In this embodiment, a mounting bracket 4 is provided upstream of the bubble generating means 2, and the mounting bracket 4 is fixedly positioned in relation to the housing 1 so as to leave a gap 41 between the housing 1 and the mounting bracket 4, and the gap 41 provides communication between the plurality of apertures 13 and the top 21 of the bubble generating means 2. The sealing means 3 is in form of an annular ring having an outer downward extending flange portion 31 and an inner upward extending flange portion 32. The outer downward extending flange portion 31 is securedly disposed at the gap 41 between the housing 1 and the mounting bracket 4 in a way to seal an end of the gap 41. The inner upward extending flange portion 42 is disposed towards an other end of the gap 41 and movable between a sealing position where it blocks communication from the plurality of apertures 13 to the top 21 of the bubble generating means 2 and a non-sealing position where it allows communication from the plurality of apertures 13 to the top 21 of the bubble generating means 2.

In this embodiment, a connector 5 having a first portion 51, a second portion 52 and a bore 53 therethrough is provided. The first portion 51 is threadedly engaged with a downstream end of the housing 1, and the second portion 52 has a threaded external wall 54 for threadedly engaging with a downstream water pipe. The connector 5 is also provided with upward extending protrusions 55 abutting against a downstream end of the body 22 of the bubble generating means 2 for supporting the bubble generating means 2 in position. The upstream end of the housing 1 is internally threaded for engaging with an upstream water pipe. The connector 5 is water-sealingly engaged with the housing by means of an O-ring 7.

In this embodiment, the housing 1 is made of plastics, but it could also be made of copper; the bubble generating means 2 is made of copper, but it could also be made of plastics.

The present embodiment operates as follows:

Water enters the housing 1 via the water inlet 11 and flows to the recess 25 via the top 21 of the bubble generating means 2; the water is then forced to pass through the water passages 26 together with the air in the recess 25, thus the water becomes aerated as it passes through the water passages 26. As air in the recess 25 is drawn to the water passages 26, air pressure in the recess 25 is reduced, thus puling the sealing means 3 to the non-sealing position to allow surrounding air to be drawn from the plurality of apertures 13 to refill the recess 25, so that water passing through the water passages 26 always has sufficient amount of air to become aerated. The aerated water then plunges onto the inner wall 14 of the housing 1 and exit through the circumferential gap 23. As the circumferential gap 23 is very narrow, any water bubbles formed in the water passages 26 would be broken up into micro-bubbles. The inward tapering of the body 22 of the bubble generating means 2 at a downstream end thereof also helps reduce pressure of water flowing from the circumferential gap 23 and to allow micro-bubbles in water flowing from the circumferential gap 23 to disperse evenly. Therefore, the bubbles in the water stream exiting from the circumferential gap 23 and thereafter the water outlet 12 of the housing 1 are micro in size. When there is no water entering the housing 1, the air in the recess 25 is not drawn to the water passages, thus the water sealing means 3 is pushed back to the sealing position so that water could not flow back to the plurality of apertures 13 and leave the housing 1.

The above embodiment is a preferred embodiment of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A micro-bubble generator for showerhead, which comprises a housing having a water inlet at a first end thereof, a water outlet at a second end thereof, and a plurality of apertures provided circumferentially around a lateral surface of the housing;

a bubble generating means securedly received within the housing and having a top which is engaged with an inner wall of the housing in a watertight manner, a body positioned downstream from the top and having a diameter smaller than diameter of the inner wall of the housing so that a circumferential gap is formed between an outer lateral surface of the body and the inner wall of the housing, and a recess coaxially extending from the top to a portion of the body, wherein a plurality of water passages extend radially outward from the recess to the outer lateral surface of the body so that each of the water passages is in communication with the circumferential gap; and a sealing means disposed between the housing and the bubble generating means which provides selective communication from the plurality of apertures to the top of the bubble generating means.

2. The micro-bubble generator as in claim 1, wherein the circumferential gap is approximately 0.5 mm in width.

3. The micro-bubble generator as in claim 1, wherein each of the water passages is approximately 1.5 mm to 2.0 mm in diameter.

4. The micro-bubble generator as in claim 1, wherein the body of the bubble generating means is tapered inwards at a downstream end thereof.

5. The micro-bubble generator as in claim 1, wherein a mounting bracket is provided upstream of the bubble generating means, and the mounting bracket is fixedly positioned in relation to the housing so as to leave a gap between the housing and the mounting bracket, and the gap provides communication between the plurality of apertures and the top of the bubble generating means; the sealing means is in form of an annular ring having an outer downward extending flange portion and an inner upward extending flange portion; the outer downward extending flange portion is securedly disposed at the gap between the housing and the mounting bracket in a way to seal an end of the gap; the inner upward extending flange portion is disposed towards an other end of the gap and movable between a sealing position where it blocks communication from the plurality of apertures to the top of the bubble generating means and a non-sealing position where it allows communication from the plurality of apertures to the top of the bubble generating means.

6. The micro-bubble generator as in claim 1, wherein a connector having a first portion, a second portion and a bore therethrough; the first portion is threadedly engaged with a downstream end of the housing, and the second portion has a threaded external wall for threadedly engaging with a downstream water pipe.

7. The micro-bubble generator as in claim 6, wherein the connector is also provided with upward extending protrusions abutting against a downstream end of the body of the bubble generating means for supporting the bubble generating means in position.

8. The micro-bubble generator as in claim 1, wherein the upstream end of the housing is internally threaded for engaging with an upstream water pipe.

9. The micro-bubble generator as in claim 1, wherein the housing is made of plastics or copper.

10. The micro-bubble generator as in claim 1, wherein the bubble generating means is made of copper or plastics.

* * * * *